US006604536B1

(12) United States Patent
Davey et al.

(10) Patent No.: US 6,604,536 B1
(45) Date of Patent: Aug. 12, 2003

(54) APPARATUS FOR REMOVING PCBS, CONTAMINANTS AND DEBRIS FROM GAS TRANSMISSION LINES

(75) Inventors: Jim Davey, Calverton, NY (US); James C. Miller, Calverton, NY (US)

(73) Assignee: Miller Environmental Group, Inc., Calverton, NY (US)

( * ) Notice: Subject to any disclaimer, the term of this patent is extended or adjusted under 35 U.S.C. 154(b) by 0 days.

(21) Appl. No.: 09/366,350

(22) Filed: Aug. 2, 1999

(51) Int. Cl.[7] ..... B08B 9/02

(52) U.S. Cl. ..... 134/104.2; 134/166 C; 134/169 C

(58) Field of Search ..... 134/104.2, 166 C, 134/169 C, 168 C, 166 R; 15/302, 321, 320

(56) References Cited

U.S. PATENT DOCUMENTS

| | | | | |
|---|---|---|---|---|
| 918,091 | A | * | 4/1909 | Roche |
| 1,328,726 | A | | 1/1920 | Dezendorf |
| 2,259,644 | A | * | 10/1941 | Kling |
| 2,356,254 | A | | 8/1944 | Lehmann, Jr. et al. |
| 2,800,134 | A | * | 7/1957 | Merritt |
| 3,010,853 | A | | 11/1961 | Elliott |
| 3,039,477 | A | * | 6/1962 | Harbo |
| 3,084,076 | A | | 4/1963 | Loucks et al. |
| 3,182,670 | A | * | 5/1965 | Howell |
| 3,536,081 | A | * | 10/1970 | Riess |
| 3,600,225 | A | | 8/1971 | Parmelee |
| 3,658,589 | A | * | 4/1972 | Shaddock |
| 4,134,174 | A | * | 1/1979 | Flynn et al. |
| 4,199,837 | A | * | 4/1980 | Frisco, Jr. |
| 4,206,313 | A | | 6/1980 | Cavoretto |
| 4,234,980 | A | * | 11/1980 | DiVito et al. |
| 4,549,966 | A | | 10/1985 | Beall |
| 4,922,571 | A | * | 5/1990 | Driear |
| 4,935,984 | A | * | 6/1990 | Bryant et al. |
| 4,995,914 | A | | 2/1991 | Teter |
| 5,007,444 | A | * | 4/1991 | Sundholm |
| 5,107,875 | A | * | 4/1992 | Sundholm |
| 5,296,039 | A | | 3/1994 | Cooper |
| 5,341,539 | A | * | 8/1994 | Sheppard et al. |
| 5,737,709 | A | | 4/1998 | Getty et al. |

FOREIGN PATENT DOCUMENTS

| | | | |
|---|---|---|---|
| DE | 286594 | * | 2/1913 |
| GB | 1188517 | * | 4/1970 |

* cited by examiner

*Primary Examiner*—Frankie L. Stinson
(74) *Attorney, Agent, or Firm*—Hiscock & Barclay, LLP; Somendu B. Majumdar

(57) ABSTRACT

An apparatus and process for removing and recovering contaminants from a pipeline while containing and preventing the contaminants from spilling or leaking into the environment during said removal comprising. Specifically, the apparatus and method effectively and safely remove PCBs from a gas transmission pipeline. The apparatus and method implements a unique coupling system the prevents dangerous contaminants from escaping into the environment. Furthermore, the apparatus and method implements and system for recycling cleaning solution for continuous treatment of the pipeline.

19 Claims, 4 Drawing Sheets

APPARATUS FOR REMOVING PCBS, CONTAMINANTS AND DEBRIS FROM GAS TRANSMISSION LINES

FIELD OF THE INVENTION

This invention is directed to a method and apparatus for cleaning and removing contaminants from a pipeline while containing and preventing the contaminants from spilling or leaking into the environment. The method and apparatus effectively removes PCBs, contaminants and debris from gas transmission pipelines so that the level of polychlorinated biphenyls (PCBs) in the pipeline is less than ten (10) micrograms per one hundred (100) square centimeters throughout the pipeline. The invention employs a cleaning solution for cleaning and removing PCBs, contaminants and other debris from gas transmission pipelines. More particularly, the method and apparatus of the invention provides a continuous process for removing PCBs, contaminants and other debris from a gas transmission pipeline while reusing filtered cleaning solution. This is accomplished by recirculating the solution back into the gas transmission pipeline for further removal of additional PCBs, contaminants and other debris that may still be present in the gas transmission pipeline being treated. The present invention implements a novel. coupling system to improve the process of cleaning transmission gas pipelines so that dangerous PCBs and other contaminants are recovered in a closed loop without spillage or leakage.

BACKGROUND OF THE INVENTION

Apparatus and methods for cleaning debris and contaminants from gas transmission pipelines are known. However, these methods and apparatus present several problems. There is a long felt need for a more effective method and apparatus for cleaning gas transmission pipelines so that they are safer for the environment.

U.S. Pat. No. 1,328,726 to Dezendorf discloses a process for cleaning service pipes by injecting a wet charge and hot, dry charges into a pipeline to be treated. However, the invention is problematic for several reasons. The invention does not disclose the reuse of cleaning solution, nor does it disclose a coupling system for preventing loss or spillage of of contaminants recovered from a pipeline. Pipelines contain contaminants that are dangerous to the environment. There is a long felt need for apparatus and method that operates as a closed environment to prevent spillage or leakage of dangerous contaminants in the process of cleaning pipelines. The present invention solves this long felt need.

U.S. Pat. No. 3,600,225 to Parmelee discloses a method for cleaning sewers by delivering jets of water from a self-propelled nozzle to the inside of a pipe to be cleaned. The invention also discloses a method for recovering the water from the sewer, cleaning the water, and reusing it to clean the sewer. However, the apparatus used in the method of cleaning sewers is problematic. The invention does not disclose a coupling system for preventing loss or spillage of of contaminants recovered from a pipeline. Furthermore, the means for recovering water from the sewer is not coupled to the means for injecting water into the sewer. The invention relies solely on one device for recovering contaminated solution. As a result, maximum contaminated water recovery is not accomplished by the apparatus and method. A coupling system would ensure maximization of water recovery. There is a long felt need for a coupling system in a conduit cleaning system for maximization of recovery of cleaning solution. Furthermore, there is a long felt need for augmenting a contaminated solution recovery means with additional recovery means, such as water pressure, for further maximization of recovery of contaminated solutions. The present invention solves these long felt needs.

U.S. Patent to 4,995,914 to Teter discloses a process for removing hazardous or toxic particulate materials from structures by directing jets of a fluid into an intake tube in the direction of air flow toward a separator chamber causing the particulates, including PCBs, to move along the intake tube to the separator chamber. This method, however, does not recycle cleaning solution for further use. Rather, it recycles air. This method can be quite costly and inefficient. The Teter invention attempts to minimize leakage of contaminants during removal by applying negative pressure to the apparatus. The Teter invention is problematic because "a small 'leak' may exist" in the application of this method and apparatus.

Other methods and apparatus for cleaning pipes and pipelines are also known. For example, U.S. Pat. No. 2,356,254 to Lehmann, Jr., et al. discloses a method for removing accumulated solid matter from pipelines by injecting a treating agent into the pipelines.

U.S. Pat. No. 3,010,853 to Eliott discloses a method for cleaning. pipes by circulating a cleaning solution under pressure through the pipes. This invention does not disclose a system for recovering the contaminated cleaning solution. This invention relies on a pump to deliver pressure through the pipe. The pressure may be sufficient to return the contaminated solution for some pipes, however, the apparatus may be incapable of recovering the solution for pipes of considerable lengths. Specifically, a recovery device, such as a vacuum, is desirable.

The Elliot invention is used to remove contaminants from the cleaning solution for reuse. However, the process for removing contaminants from the cleaning solution is problematic. Specifically, this patent discloses a chemical reaction for cleaning the contaminated solution. The chemical reaction may not be effective in removing other types of contaminants.

U.S. Pat. No. 3,084,076 to Loucks, et.al. discloses a method for cleaning the interior of pipes by injecting a cleaning material into a pipeline in a substantially vaporous state.

U.S. Pat. No. 4,206,313 to Cavoretto discloses a nozzle for cleaning the interior wall of a pipe.

U.S. Pat. No. 4,549,966 to Beall discloses a method for removing contaminants, such as PCBs, from an aqueous composition by bringing the composition into contact with an organo-clay compound.

U.S. Pat. No. 5,296,039 to Cooper discloses a method for inserting compressible pigs into a pipeline.

U.S. Pat. No. 5,737,709 to Getty, et al. discloses a method for removing explosive agents from the interior of explosive, agent-filled bodies by using high pressure fluid jets.

While these known apparatus and methods for pipelines and other structures are of interest, they do not address the particular need to remove or decrease the level of PCBs in gas transmission pipelines so that they will be safer for the environment.

SUMMARY OF THE INVENTION

The method and apparatus of the present invention is effective method and apparatus that operates as a closed environment to prevent spillage or leakage of dangerous contaminants in the process of removing contaminants from pipelines. Particularly, the present invention is effective removing contaminants, including PCBs and other debris, from gas transmission pipelines so that the level of PCBs in the pipeline is less than ten (10) micrograms per one hundred (100) square centimeters throughout the pipeline.

In general, the apparatus of the invention effectively cleans and removes contaminants from a pipeline while containing and preventing the contaminants from spilling or leaking into the environment during the removal. The apparatus comprises: connecting means for forming a closed loop with the pipeline for continuous cleaning of the pipeline; means for placing a cleaning medium into said closed loop; pumping means for delivering said cleaning medium through said closed loop and the pipeline; and recovering means for recouping the contaminants and cleaning medium from the pipeline so that the contaminants and said cleaning medium are prevented from spilling or leaking into the environment.

The main object of the present invention is to provide a method and apparatus that operates as a closed environment to prevent spillage or leakage of dangerous contaminants in the process of cleaning pipelines.

Another object of the present invention is to provide a method and apparatus that effectively cleans gas transmission pipelines so that the level of PCBs in the pipeline is less than ten (10) micrograms per one hundred (100) square centimeters throughout the pipe.

Another object of the present invention is to produce a method and apparatus that provides a new coupling system in a pipeline cleaning system that improves and maximizes recovery of cleaning solution.

Another object of the present invention is to provided a method and apparatus that improves the recovery of pipeline cleaning solution by combining multiple means for recovering the solution.

Additional objects and advantages will become apparent from the foregoing description.

BRIEF DESCRIPTION OF THE DRAWING

The method and apparatus of the invention will become more apparent from the ensuing description when considered together with the accompanying drawing wherein.

DETAILED DESCRIPTION OF THE DRAWINGS AND THE INVENTION

The present invention is for an apparatus and method for removing contaminants from pipelines. The following description of the apparatus and method is divided into three parts. The first section describes the power sources implemented and the means for attaching the components of the apparatus. The second section describes the means implemented for cleaning the pipeline and their configuration. The third section discusses the method of using the apparatus for cleaning pipelines.

I. Power Sources Implemented and the Means for Attaching the Components of the Apparatus The following material describes the power sources implemented for operation of apparatus. Furthermore, the following materials describes the means used for attaching the components of the apparatus to the vehicle.

Figure 1:
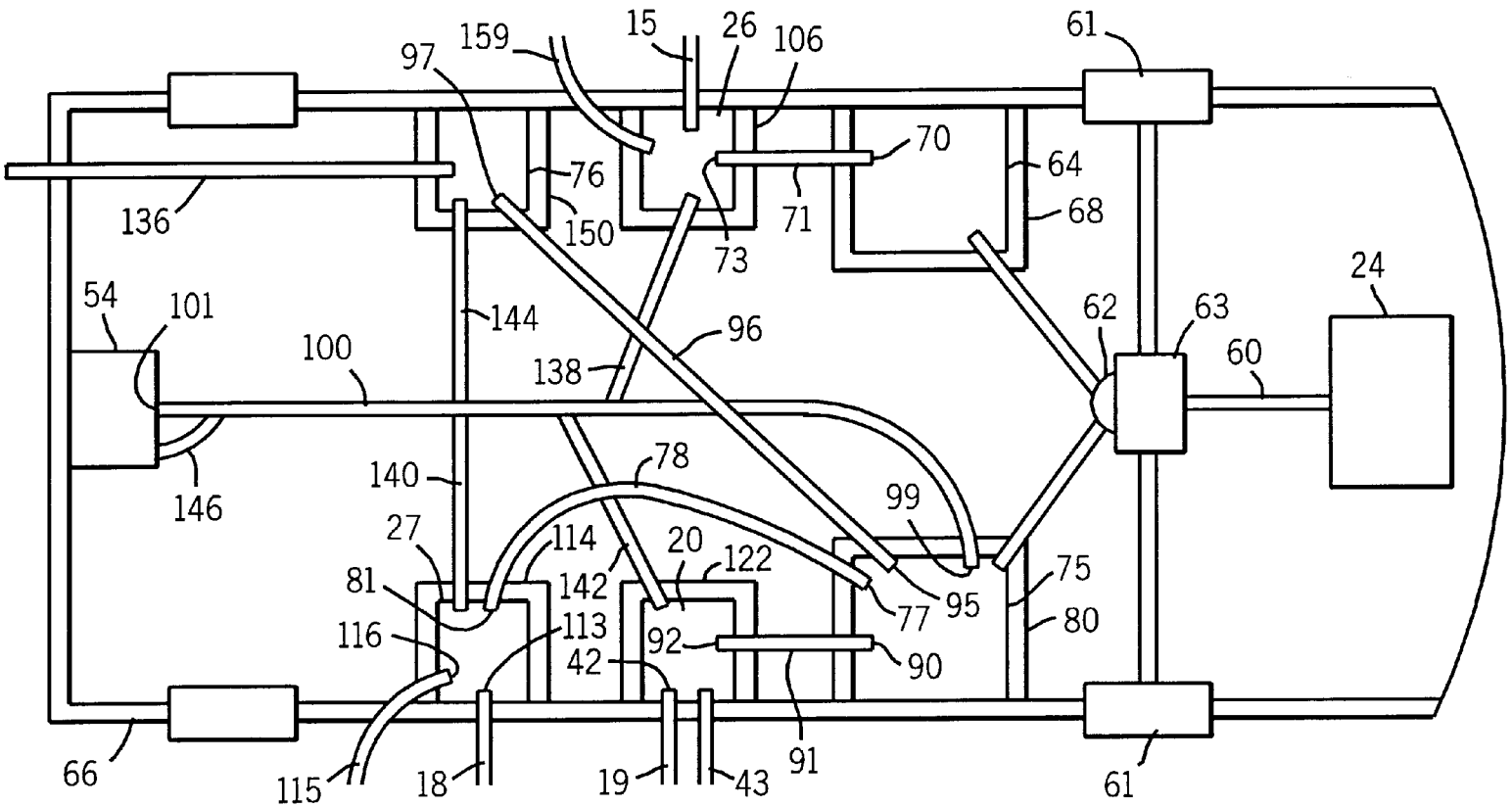
FIG. 1 is a schematic perspective view of the bottom side of a chassis of a vehicle implemented in one embodiment of the apparatus that can be used to practice the invention.
Figure 2:
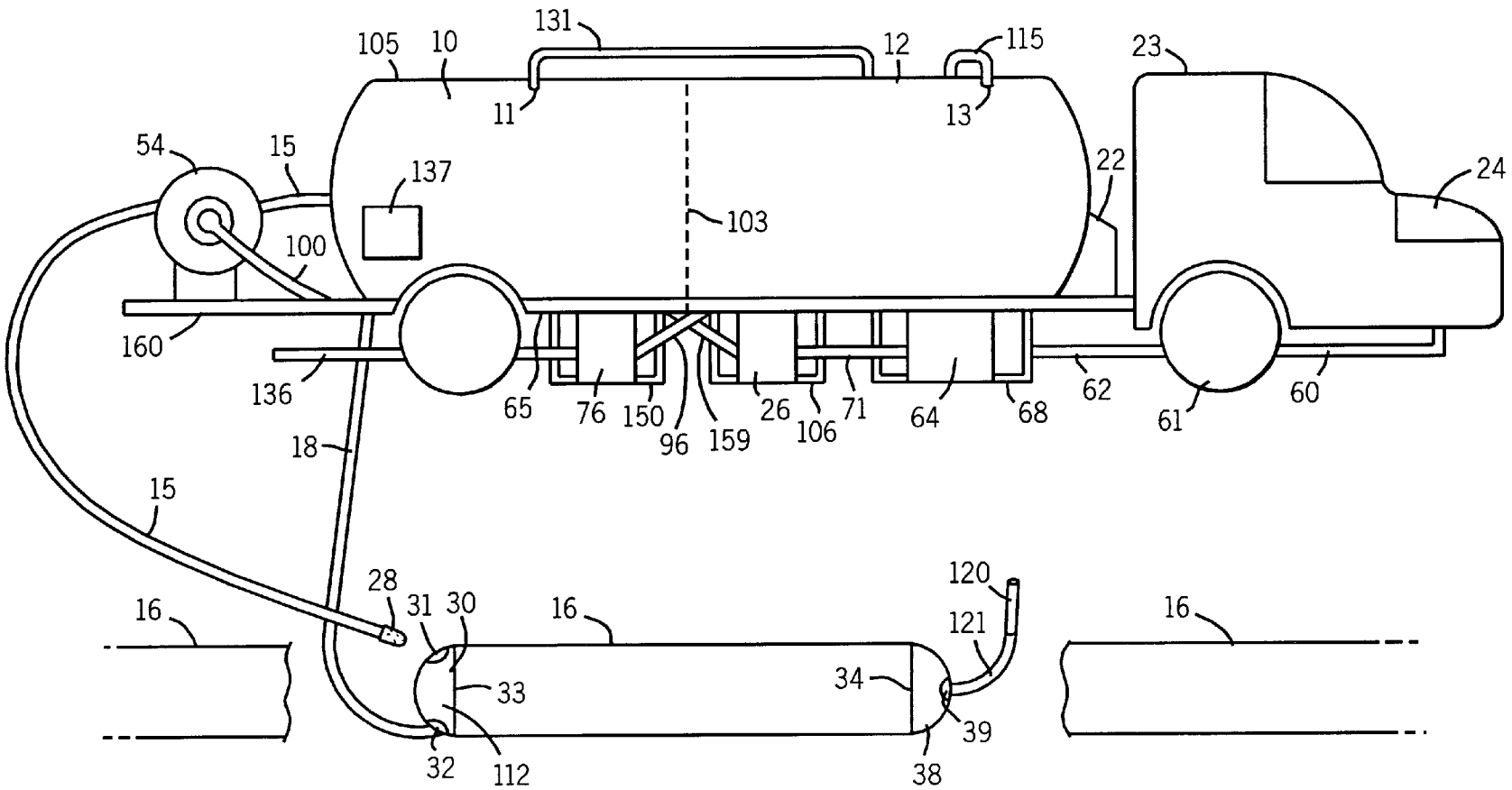
FIG. 2 is a schematic perspective view of one embodiment of the apparatus that can be used to practice the invention further describing FIG. 1.

Turning to the drawing wherein like reference numerals denote like parts, FIG. 2 illustrates one embodiment of an apparatus that can be used having a transportable vehicle 23 and an engine 24. In one embodiment, transportable vehicle 23 is a truck and engine 24 is a six cylinder diesel engine which is commercially available. However, other transportable vehicles and other engines with sufficient power may be implemented. For example, an electric engine may be used to power the apparatus. Engine 24 can be used to power both the vehicle 23 and the apparatus described below. Preferably, vehicle 23 is a motor vehicle and engine 24 is connected to drive shaft 60 of vehicle 23. Vehicle 23, engine 24 and drive shaft 60 are all standard equipment supplied and installed by the manufacturer of the motor vehicle. Engine 24 activates the drive shaft 60 which in turn rotates wheels 61. As a result, vehicle 23 is set in motion. A transfer unit 62 is welded to drive shaft 60 by a double universal joint 63. However, other attachment methods may be employed. Transfer unit 62 and double universal joint 63 are well known and may be obtained from transmission manufacturers such as Allison. Transfer unit 62 transfers the engine's 24 power to the apparatus rather than to wheels 61. The power supplied by engine 24 is transferred to a first hydraulic motor 64 and to a second hydraulic motor 75. Hydraulic motors 64(Jet Side) and 75 (Vac Side) transfer the engine's power throughout the apparatus for operation. The Jet Side of transfer unit 62 requires direct drive from the engine. The Jet Side of transfer unit 62 is connected to hydraulic motor 64 with gears and shafts. Gears and shafts are well known and commercially available. The Vac Side of transfer unit 62 is connected to hydraulic pump 75 with gears off of the drive shaft.

Hydraulic motor 64 is mounted to vehicle 23. Hydraulic motor 64 is commercially available and may be obtained from suppliers such as Commercial Intertech. However, other motors, such as gear-driven motors, may be used as well. Hydraulic motor 64 supplies fluid pressure and power for the operation of jet pump 26 (discussed below). Preferably, hydraulic motor 64 is capable of producing a pressure of twenty five hundred (2500) pounds per square inch (p.s.i.) and a flow rate ranging between twenty five (25) and thirty (30) gallons per minute (g.p.m.). However, hydraulic pump 64 may produce other pressures and flow rates capable of cleaning a gas transmission pipeline. In one embodiment, hydraulic motor 64 is mounted to the bottom side 65 of chassis 66 of vehicle 23. Beams may be welded to bottom side 65 of chassis 66 to form a support unit 68. Support unit 68 may be made of steel or another material capable of supporting hydraulic motor 64. Hydraulic motor 64 is then fixed to support unit 68. This may be done by welding, however, other attachment means may be employed. End 70 of hydraulic hose 71 is attached to the discharge end of hydraulic motor 64. End 73 of hydraulic hose 71 is attached to inlet end of jet pump 26. Preferably, hydraulic hose 71 is coupled to jet pump 26 and hydraulic motor 64. However, other attachment methods may be employed. Hydraulic pump 64 is well known and may obtained from commercial sources such as Commercial Intertech.

A pump 26 is attached to bottom side 65 of chassis 66 of vehicle 23. Preferably, pump 26 is fixed to chassis 23 by welding. However, other conventional attachment means may be used. Additionally, an angle iron support structure 106 may be fixed, by welding for example, to chassis 66 to provide additional support to pump 26. An iron angle support may be made of steel and constructed at a ninety degree angle to support heavy objects.

Hydraulic motor 75 is mounted to vehicle 23. Hydraulic motor 75 may be obtained from commercial sources such as Commercial Intertech. Hydraulic motor 75 supplies fluid pressure and, power for the operation of the components of the apparatus. These components include vacuum pump 27, cleaning solution transfer pump 20, winch 76 and hydraulic reel 54 (all discussed in detail below). Preferably, hydraulic motor 75 is capable of producing a pressure of twenty five hundred (2500) pounds per square inch (p.s.i.) and a flow rate ranging between twenty five (25) and thirty (30) gallons per minute (g.p.m.). However, the hydraulic pump may be capable of producing other pressures and flow rates for cleaning a gas transmission pipeline or other pipelines. Preferably, hydraulic motor 75 is mounted to the bottom side 65 of chassis 66 of vehicle 23. Beams 79 may be welded to bottom side 65 of chassis 66 to form a support unit 80. Support unit 80 may be made of steel or any other material capable of supporting hydraulic motor 75. Hydraulic motor 75 is then fixed to support unit 80. This may be done by welding, however, other attachment methods may be employed.

Vacuum pump 27 is attached to bottom side 65 of chassis 66 of vehicle 23. Preferably, vacuum pump 27 is fixed to chassis 23 by welding. However, other conventional means may be used for fixing vacuum pump 27 to vehicle 23. In addition, an angle iron support structure 114 may be fixed, by welding for example, to chassis 66 to provide additional support to vacuum pump 27.

Cleaning solution transfer pump 20 is attached to bottom side 65 of chassis 66 of vehicle 23. Preferably, cleaning solution transfer pump 20 is fixed to chassis 23 by welding. However, other conventional means may be used for fixing cleaning solution transfer pump 20 to vehicle 23. In addition, an angle iron support structure 122 may be fixed, by welding for example, to chassis 66 to provide additional support for cleaning solution transfer pump 20.

A conduit reel 54 is attached to vehicle 23 for storing conduit 15. Conduit reel may be attached by welding to the base of the truck. Preferably, reel 54 is a retractable hydraulic reel capable of storing and retracting conduit 15. In one embodiment, reel 54 is mounted on reel frame support 160. Wheel frame support 160 may be attached to the chassis of the truck by welding. The hydraulic reel is driven by hydraulic motor 75.

Winch 76 is attached to bottom side 65 of chassis 66 of vehicle 23. In one embodiment, winch 76 is fixed to chassis 23 by welding. However, other conventional means may be used for winch 76 to vehicle 23. In addition, an angle iron support structure 122 may be fixed, by welding for example, to chassis 66 to provide additional support for winch 76.

End 77 of hydraulic hose 78 is attached to the discharge end of hydraulic motor 75. End 81 of hydraulic hose 78 is attached to the inlet end of vacuum pump 27. Preferably, hydraulic hose 78 is coupled to vacuum pump 27 and hydraulic motor 75. Conventional screw couplings may be used, however, other attachment methods may also be employed. Hydraulic hose 78 is well known and may be obtained from commercial sources such as Commercial Intertech. In one embodiment, hydraulic hose 78 is one half inch in diameter. However, other hydraulic hose diameters may be used.

End 90 of hydraulic hose 91 is attached to the discharge end of hydraulic motor 75. End 92 of hydraulic hose 91 is attached to the inlet end of cleaning solution transfer pump 20. Preferably, hydraulic hose 91 is coupled to cleaning solution transfer pump 20 and hydraulic motor 75. Conventional screw couplings may be used, however, other attachment methods may be also employed. Hydraulic hose 91 is well known and may be obtained from commercial sources such as Commercial Intertech. Preferably, hydraulic hose 91 is one half inch in diameter. However, other hydraulic hose diameters may be used.

End 95 of hydraulic hose 96 is attached to the discharge end of hydraulic motor 75. End 97 of hydraulic hose 96 is attached to the inlet end of winch 76. Preferably, hydraulic hose 96 is coupled to cleaning solution transfer pump 20 and hydraulic motor 75. Conventional screw couplings may be used, however, other attachment methods may also be employed. Hydraulic hose 96 is well known and may be obtained from commercial sources such as Commercial Intertech. In one embodiment, hydraulic hose 96 is one half inch in diameter. However, other hydraulic hose diameters may be used.

End 99 of hydraulic hose 100 is attached to the discharge end of hydraulic motor 75. End 101 of hydraulic hose 100 is attached to the inlet end of hydraulic reel 54. Preferably, hydraulic hose 100 is coupled to cleaning solution transfer pump 20 and hydraulic motor 75. However, other attachment methods may be employed. Hydraulic hose 100 is well known and may be obtained from commercial sources such as Commercial Intertech. In one embodiment, hydraulic hose 100 is one half inch in diameter. However, other hydraulic hose diameters may be used.

II. Means Implemented for Cleaning the Pipeline and Their Configuration

The following material describes the means implemented for cleaning gas transmission pipelines and other pipelines. The following material also describes the configuration of the means implemented.

Figure 3:
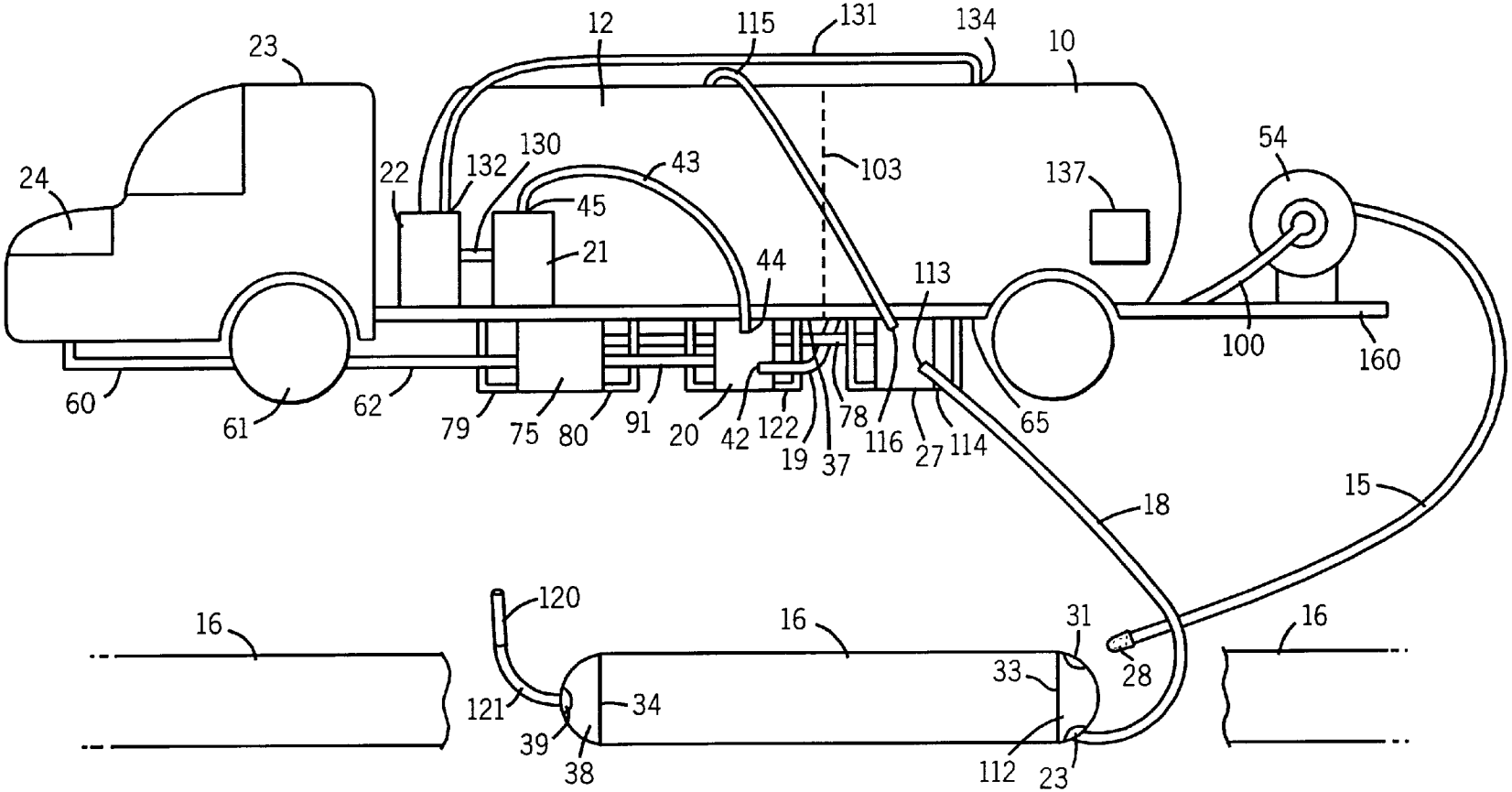
FIG. 3 is another perspective view of the embodiment of the apparatus shown in FIGS. 1 and 2.

FIGS. 2 and 3 illustrate one embodiment of an apparatus that can be used to clean pipelines. The apparatus contains a first compartment 10 and a second compartment 12. Dividing wall 103 separates compartments 10 and 12. In the embodiment shown in FIGS. 2 and 3, compartments 10 and 12 are provided in the form of elongated cylinders, but they can be of any shape or form such as spherical, oblong, rectangular, and the like, provided they are of a size sufficient to accommodate the quantity of cleaning solution medium needed to treat the length of a particular gas transmission pipeline. In one embodiment, compartments 10 and 12 are Department of Transportation (DOT) specified tanks. Such tanks may be obtained from commercial sources such as Amthor and Press-vac. These tanks could be constructed of carbon steel, stainless steel or other materials. Other tanks are suitable for cleaning other types of pipelines and conduits. Collectively, compartment 10 and compartment 12 shall be referred to as a tank system. In one embodiment, compartments 10 and 12 are capable of storing one thousand (1000) gallons of cleaning solution. However, compartments 10 and 12 may be of any volume capable of storing a sufficient amount of cleaning solution to treat a particular pipeline Compartment 10 operates as a supply source, for the cleaning solution and compartment 12 operates as a reservoir for storing solution contaminated with PCBs and other debris. The tank system is fixed to chassis 66 of vehicle 23. The tank system may be attached to the chassis 66 of vehicle 23 by welding or by other conventional manufacturing processes. In another embodiment, compartments 10 and 12 can be attached to a skid mounted unit on a flat bed vehicle, a trailer unit, or similar vehicles for ease of mobility.

Compartment 10 has an inlet end 11 and compartment 12 has an inlet end 13. Pump 26 provides pressure for delivering cleaning solution from compartment 10 to pipeline 16. Preferably, pump 26 is a piston pump capable of delivering liquids at a pressure ranging between fifteen hundred (1500) and three thousand (3000) psi. However, other pumps capable of delivering sufficient pressure to clean a particular pipeline may be used. Pump 26 is commercially available and is known as a General MS-55 piston pump. However, other pumps capable of cleaning a pipeline may be used. Pumps 26 and similar pumps may be obtained from commercial sources such as Aquatech, Goodwin and Guzzler. Hydraulic motor 64 powers pump 26. A conduit 159 is connected by coupling fitting compartment 10 and the inlet end of pump 26. Another conduit 15 is connected to the outlet end of pump 26 by conventional hose coupling fittings and stored on hydraulic reel 54. Coupling fittings may be obtained from commercial sources such as Moreland. Conduit 15 may be a hose, a pipe, or any other similar structure. Preferably, conduit 15 is a flexible hose. Conduit 15 may vary in diameter and length. In one embodiment, the diameter of conduit 15 is three fourths of an inch (¾") and the length is four hundred (400) feet. Conduit 15 may be of any length and diameter sufficient to treat a particular gas transmission pipelines. Conduit 15 is equipped with a spray nozzle 28. Conduit 15 is employed as a means for discharging cleaning solution through spray nozzle 28. Preferably, a radial vortex nozzle is used for cleaning gas transmission pipelines because the nozzle traverses through the pipeline without drawing contact with the pipeline's surface. All surfaces of the pipeline are sprayed with the cleaning solution. Spray nozzle 28, including a radial vortex nozzle, is well known and may be obtained from commercial sources such as Aquatech and Flowtek. However, other spray nozzles may be used.

Figure 4:
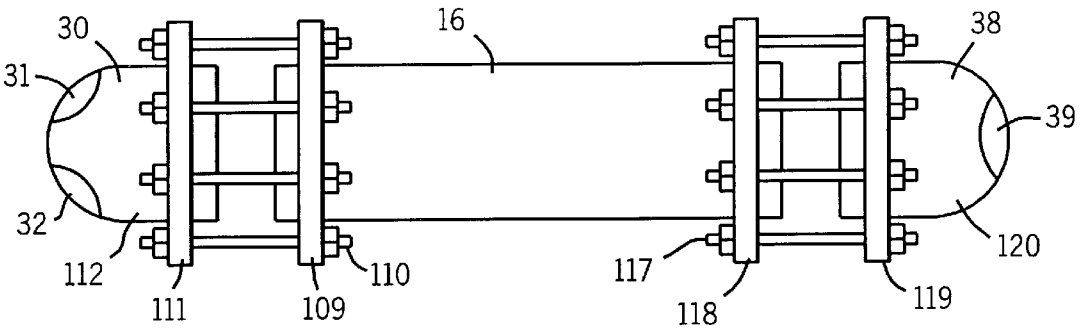
FIG. 4 is a view of the couplings shown in FIGS. 2 and 3.
Figure 6:
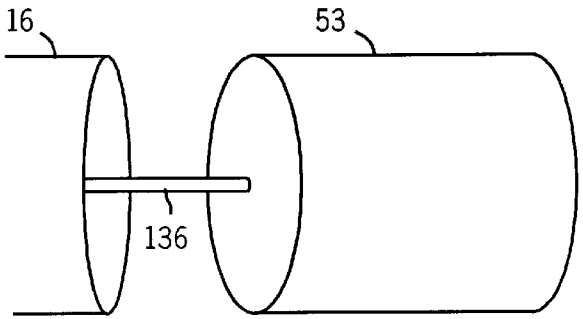
FIG. 6 is view of a pig used in the method described herein.
Figure 7:
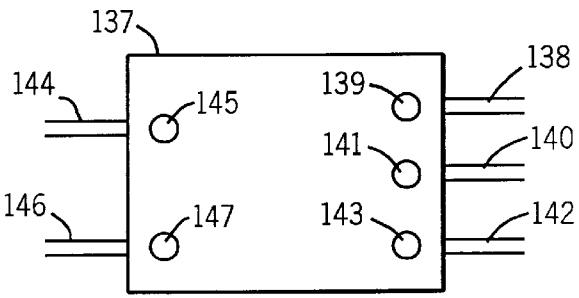
FIG. 7 is a detailed view of the operator control panel shown in FIGS. 2 and 3.
Figure 5:
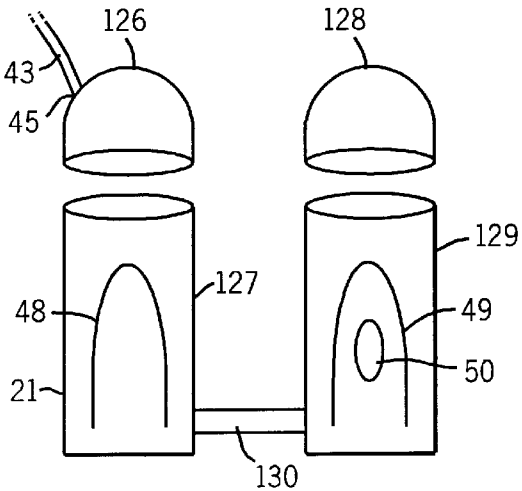
FIG. 5 is a view of the filtering system shown in FIG. 3.

The pipeline 16 to be treated is radially cut at end 33 and end 34 of pipeline 16. A first coupler 30 is attached to end 33 of pipeline 16. In one embodiment, a Dresser coupler is used. Dresser couplers are well known and may be obtained from Dresser. However, other types couplers capable of attaching to a pipeline may also be used. Coupler 30 operates as a plug to prevent materials from leaking out of pipeline 16. Referring to FIG. 4, coupler 30 has a back end 109 with a gasket 110 and a front end 111 with a dome 112. When coupler 30 is attached to pipeline 16, it plugs the pipeline by interlocking rubber gasket 110 with dome 112 and thereby forming a seal with pipeline 16. Hole 31 is cut on the pump side of dome 112 of coupler 30 so that spray nozzle 28 may be inserted into the hole. Another hole 32 is cut on the vacuum side of dome 112 of coupler 30. Conduit 18 is inserted into hole is attached to hole 32 of coupler 30 by conventional coupling clamps. However, other attachment means may be used. Conduit 18 is also connected to inlet end 113 of vacuum pump 27 by conventional coupling clamps. However, other attachment means may also be used.

Vacuum pump 27 is used for recovering contaminated cleaning solution from pipeline 16. A conduit 115 is coupled to discharge end 116 of vacuum pump 27 and is also coupled to inlet end 13 of compartment 12. Vacuum pump 27 is well known and may be obtained from commercial sources such as Masport and may be purchase from suppliers such as Ampthor. Preferably, vacuum pump 27 vacuums approximately three hundred (300) cubic feet per minute (cfm)or greater. Other means for collecting liquids and debris may be used as well. Preferably, conduit 115 is a hose. Hoses may be obtained from commercial sources such as Moreland. Conventional coupling clamps may be used for attaching conduit 115. However, other connection means may also be used.

Referring to FIG. 4, a second coupler 38 is attached to end 34 of pipeline 16. Coupler 30 operates as a plug to prevent materials from leaking out of pipeline 16. Coupler 38 has a back end 117 with a gasket 118 and a front end 119 with a dome 120. When coupler 38 is attached to pipeline 16, it plugs the pipeline by interlocking gasket 118 with dome 120 and thereby forming a seal with pipeline 16. In one embodiment, a Dresser coupler is used, however types of couplers may be used. Coupler 38 is cut with a hole 39 for venting pipeline 16. This aids in the vacuuming and recovery of contaminated cleaning solution. Preferably, a male quick connect device 121 is permanently mounted to coupler 38 by welding it hole 39. A female quick connect hose 120 is attached to male quick connect device 121 to aid in the recovery overflowing liquids. Quick connect hose 120 and quick connect device 121 may be obtained from commercial sources such as Evertight. However, other recovery devices may also be implemented. In one embodiment, hole 39 has a three-quarter (¾) inch diameter, although other diameters may also be used.

The bottom side of compartment 12 contains an opening 37 (not shown) for discharge of contaminated cleaning solution. The inlet end of conduit 19 is attached to opening 37 (not shown) of compartment 12. Preferably, conduit 19 is a hard pipe, such as steel. However, conduit 19 may be constructed of other materials such as a hose. Discharge end 42 of conduit 19 is attached to the inlet end of cleaning solution transfer pump 20. Conduit 19 may be attached to compartment 12 and cleaning solution transfer pump 20 by conventional screw couplings. However, conduit 19 may also be attached by other methods such as welding. In another embodiment, conduit 19 may be a hose and connected by conventional clamp couplings.

Cleaning solution transfer pump 20 is used for transferring contaminated cleaning solution from compartment 12, through filter 21 and filter 22, and back into compartment 10 for reuse. Cleaning solution transfer pump 20 is well known may be obtained from commercial sources such as Bowie and Guzzler. In one embodiment, cleaning solution transfer pump 20 is a Bowie three inch positive displacement pump. However, other types of pumps capable of delivering contaminated solution to filter 21, 22 and compartment 10 may be used. Inlet end 44 of conduit 43 is connected to discharge end of cleaning solution transfer pump 20. Discharge end 45 of conduit 43 is attached to the inlet end of filter 21. Preferably, conduit 43 is a steel pipe and attached by conventional screw couplings. However, conduit 43 may consist of a material capable of transferring cleaning solution, such as a hose. In one embodiment, conduit 43 is three inches (3") in diameter, although it may be of other diameters.

A dual filtering system is attached to the apparatus for filtering PCBs, debris and other contaminants from contaminated cleaning solution. The filters are attached to vehicle 23 by welding, however, other attachment means may be used. Filtering system 47 consists of a first filter 21 and second filter 22 for filtering contaminated cleaning solution for reuse. In one embodiment, filter 21 and filter 22 are Rosedale filters. Rosedale filters are well known and may be obtained from commercial, sources such as U.S. Filtration Company and Filtronics Inc. Other filters, such as particulate separators, may also be implemented. In one embodiment, filters 21 and 22 are each two foot pressure cylinders with a six (6) inch diameter. However, filters 21 and 22 may be of other heights and diameters. A sock filter 48 is placed in filter 21. This may be done by removing pressure top 126 of filter 21, placing sock filter 48 in unit 127, and placing pressure top 126 back on filter 21. In one embodiment, a five (5) micron sock filter is used. Micron sock filters are well known and may be obtained from commercial sources such as Carbatrol. However, other particulate sized filters may be used. A sock filter 49 and organo clay 50 are also placed in filter 22. This may be done by removing pressure top 128 of filter 21, placing sock filter 49 in unit 129, and placing pressure top 128 back on filter 21. In one embodiment, a five (5) micron sock filter is used. However, other particulate sized filters may be used. Organo clay is effective in removing PCBs and other contaminants from water and other solutions. Organo clay is well known and may obtained from commercial sources such as Carbatrol. Organo clay is used as a filtering means to augment the sock filter. Materials similar to organo clay, such as diatomaceous earth, may be also be used. Filter 21 is connected to filter 22 by a hard pipe 130. In one embodiment, hard pipe 130 is steel, however, other materials may be used. Hard pipe 130 is connected to filter 21 and filter 22 by conventional screw couplings. Screw couplings are commercially available.

Filter 22 is connected to compartment 10 by conduit 131. Preferably, conduit 131 is a rubber hose. However, conduit 131 may be a pipe or a similar transfer means. Inlet end 132 of conduit 131 is connected to discharge end 133 of filter 22. Discharge end 134 of conduit 131 is connected to inlet end 135 of compartment 10 for receiving filtered cleaning solution. Conduit 131 may be connected by conventional coupling clamps. However, similar connection means may also be used. Rubber hoses and clamps may be obtained from commercial sources such as Moreland.

Conduits 15, 18, 19 and 43 may be provided from any suitable materials such as rigid pipe or flexible hose. However, all of the conduits should be capable of withstanding the flow of the cleaning solution at a relatively high pressure. Preferably, conduits 15 and 18 are flexible hoses. Employing flexible hoses for conduits 15 and 18 requires less storage space, is less time consuming to assemble and disassemble, and facilitates access to a gas transmission pipelines to be treated that may be restricted by space or are otherwise difficult to reach.

Conduit reel 54 is used for storing and retracting conduit 15. Preferably, reel 54 is a retractable hydraulic reel capable of storing and retracting conduit 15. Reel 54 may pivot to allow the hose to retract at different angles. Hydraulic reel 54 may be obtained from commercial sources such as Commercial Intertech. Other types of reels, such as a gear driven retractable system may be used. The hydraulic reel is driven by hydraulic motor 75. Preferably, conduit 15 is a hose.

Winch 76 provides power for pulling a pig 53 through pipeline 16. Winch 76 is well known and commercially available. Winch 76 is provided with a winch cable 136. Pig 53 is provided for removing excess cleaning solution, PCBs, contaminants and other debris from pipeline 16. Pigs are well known and commercially available. Preferably, a foam pig is used. However, other pigs may be used. In one embodiment, a five-eighths inch (5/8") winch cable is used to pull pig 53 through pipeline 16. However, other sized winch cables may be used.

An operator control panel 137 is attached to vehicle 23 for independently controlling the output of jet pump 26, vacuum pump 27, cleaning solution transfer pump 20, winch 76 and hydraulic reel 54 (each of which may be generically referred to as a power device). The operator control pump panel may be attached to the rear of the truck. However, the control panel may be attached to other portions of the truck. The control panel may be attached by welding, bolts, or other attachment means. Pump 26 is connected to operator control panel 137 by a hydraulic control 138. Each hydraulic control unit is plumbed to the reel of the truck by hose 100. Operator control panel 137 is the terminus point of each line connected to the operator control panel 137. The operator control panel 137 contains a hydraulic valve 139 for controlling the output of jet pump 26. Vacuum pump 27 is connected to operator control panel 137 by hydraulic control 140. The operator control panel 137 contains a hydraulic valve 141 for controlling the output of vacuum pump 27. Cleaning solution transfer pump 20 is connected to operator control panel 137 by hydraulic control 142. The operator control panel 137 contains a hydraulic valve 143 for controlling the output of cleaning solution transfer pump 20. Winch 76 is connected to operator control panel 137 by hydraulic control 144. The operator control panel 137 contains a hydraulic valve 145 for controlling the output of winch 76. Hydraulic reel 54 is connected to operator control panel 137 by a hydraulic control 146. The operator control panel 137 contains a hydraulic valve 147 for controlling the output of hydraulic reel 54. Operator control panel 137, hydraulic controls 138, 140, 142, 144 and 146, and hydraulic valves 139, 141, 143, 145 and 147 may be obtained from commercial sources such as Commercial Intertech.

III. The Method of Using the Apparatus for Cleaning Pipelines

The following section describes the method of cleaning a pipeline using the apparatus described above.

In practice, the apparatus of the invention is conveyed to the site of the gas transmission pipeline to be treated by means of vehicle 23. Pipeline 16 is radially cut at end 33 and end 34. Coupler 30, with hole 31 and hole 32, is attached to end 33 of pipeline 16 for preventing escape of materials from pipeline 16. Coupler 38, with hole 39, is attached to end 34 of pipeline 16. Conduit 15, with spray nozzle 28, is inserted into hole 30. Conduit 18 is attached to hole 32 of the coupler. Compartment 10 is filled with a sufficient amount of cleaning solution to conduct the treatment. Terpene cleaning solution, containing Citrikleen, is the preferred cleaning solution. Terpene is a citrus based cleaner. In one embodiment, the terpene cleaning solution comprises ten parts of water to one part of terpene. Terpene cleaning solution is well known and may be obtained from commercial sources such as West Penetone Corp. However, other cleaning solutions, such as diesel fuel, may be used. Compartment 10 may be filled with the cleaning solution, for example, by vacuuming the solution into compartment 12 and bypassing filter system 47, thereby feeding the solution directly into compartment 10.

Engine 24 is activated to power the apparatus 14. Jet pump 26 transfers the cleaning solution from compartment 10 to conduit 15 by providing pressure to the conduit. The cleaning solution is transferred by pump 26 from compartment 10 to conduit 15. The pressure from jet pump 26 causes spray nozzle 28 to traverse the pipeline and discharge the cleaning solution to the interior surface of pipeline 16. The cleaning solution is discharged at a pressure varying from approximately fifteen hundred (1500) and three thousand (3000) p.s.i. (or approximately twenty (20)–forty (40) gpm). The pressure flow of the cleaning solution may be controlled by adjusting hydraulic control 138 to the desired pressure. This pressure causes the spray nozzle 28 to traverse pipe 16 in a reverse fashion. Spray nozzle 28 discharges cleaning solution along the length of the interior of pipeline 16. The cleaning solution has a scouring effect on the inner wall of the pipeline being treated. Hydraulic reel 54 is activated to retract conduit 15 when spray nozzle 28 reaches end 34 of pipeline 16. Conduit 15 is retracted toward end 33 of pipeline 16. During retraction, spray nozzle 28 continues to discharge cleaning solution so that the interior surface of pipeline 16 is cleaned again.

The discharged cleaning solution removes PCBs, contaminants and other debris from the interior of pipeline 16. The discharged cleaning solution becomes saturated with these contaminants. The contaminated cleaning solution must be removed from pipeline 16. There are several factors that contribute to drawing the contaminated cleaning solution from pipeline 16. This is mainly accomplished by vacuum pump 27. Vacuum pump 27 draws the cleaning solution from pipeline 16, through conduit 18, through conduit 115 and into compartment 12. The contaminated solution is also drawn from pipeline 16 when conduit 15 is retracted. Spray nozzle 28 sprays the solution toward hole 32 of coupler 30. The contaminated solution is also drawn from pipeline by gravity when coupler 30 is located at a the low point of the treated pipeline. All of these factors cause the contaminated cleaning solution to be drawn from pipeline 16.

Vacuum pump 27 transfers the contaminated cleaning solution to compartment 12 by vacuum pump 27. The contaminated solution exits compartment 12, by gravity, through hole 37 and flows into conduit 19. Cleaning solution transfer pump 20 propels the contaminated solution conduit 43 and to the filter system where PCBs and other contaminants are removed from the cleaning solution and thereby rendering the cleaning solution reusable. Preferably, sock filters 48 and 49 and organo clay 50 are manually removed and replaced after treating pipeline 16. The solution may be reused for many cycles provided that the PCB level in the cleaning solution is maintained at a level below fifty (50) parts per million of PCB. The use of recycled cleaning solution is desirable because it is cost efficient and saves valuable time in cleaning pipelines.

Cleaning solution transfer pump 20 sends the filtered cleaning solution, through conduit 131, to compartment 12 for reuse. The length of gas transmission pipeline is treated and cleaned by the foregoing process at least three times. At least ninety five percent (95%) of the cleaning solution must be recovered from the pipeline so that it is safe fort he environment and in compliance with EPA standards. However, the percentage may vary according to changes in EPA standards. Therefore, during the final treatment, pig 53 is pulled through the length of gas transmission pipeline being treated thereby recovering any remaining solution and contaminants. Pig 53 is pulled through pipeline 16 to aid in the recovery of excess solution, PCBs and other debris from pipeline. This process is well known. Before the final treatment (e.g., the third cleaning cycle), spray nozzle 28 is removed from the pipeline and winch cable 136 is attached said spray nozzle. Spray. nozzle 28, with winch cable 136, is inserted in hole 31 of coupler 30 for final treatment. When spray nozzle 28 reaches end 34 of pipeline 16, coupler 38 is removed. Vacuum 27 continues to recover any solution in the pipeline. Pig 53 is attached to winch cable 136 and inserted into pipeline 16 and the winch cable 136 is retracted by winch 76. Pig 53 is pulled toward end 33 of pipeline 16. As a result, at least ninety five percent (95%) of the cleaning solution is removed from pipeline 16.

Pipeline 16 is tested to verify that the level of PCBs is less than ten (10) micrograms per 100 square centimeters throughout the pipe. The test is known as a PCB wipe sample and is well known.

Although the invention has been described with particularity and in some detail, it will be appreciated by those skilled in the art that changes and modifications can be made therein without departing from the scope of the invention.

What is claimed is:

1. An apparatus for cleaning and removing contaminants from a pipeline while containing and preventing the contaminants from spilling or leaking into the environment during said removal comprising:

(a) connecting means for forming a closed loop with a pipeline for continuous leaning of said pipeline;

(b) a first storage means for a leaning medium;

(c) pump means for delivering said cleaning medium from said first storage means to and through said closed loop and said pipeline;

(d) means for recovering and removing contaminated cleaning medium from said closed loop and said pipeline; and (e) means for transferring said recovered and removed contaminated cleaning medium to second storage means such that said contaminated cleaning medium is prevented from spelling or leaking into the environment.

2. The apparatus of claim 1 further comprising:

(a) a first filtering means for removing said contaminants from said contaminated cleaning medium;

(b) a second filtering means for further removing said contaminants from said contaminated cleaning medium such that said contaminated cleaning medium is decontaminated for reuse; and, (c) a transfer pump means for delivering said contaminated cleaning medium from said second storage means to said first filtering means, to said second filtering means and back into said first storage means.

3. The apparatus of claim 2, wherein said pumping means is a piston pump capable of delivering 1500–3000 psi, said vacuuming means is a vacuum pump capable of delivering approximately 300 cfm and said transfer pump means is a three inch positive displacement pump.

4. The apparatus of claim 2, wherein said first filter contains a first sock filter and said second filter contains a second sock filter and organo clay.

5. The apparatus of claim 4, wherein said first sock filter and said second sock filter are each five micron sock filters.

6. The apparatus of claim 2, wherein said first and second compartments comprise one thousand gallon containers for storing said cleaning medium.

7. The apparatus of claim 2, wherein said connecting means for forming a closed loop further comprises:

a first conduit for delivering said cleaning medium to said pumping means;

a second conduit for delivering said cleaning medium from said pumping means to the pipeline;

a third conduit for delivering from the pipeline recovered contaminated cleaning medium to said vacuuming means, said vacuuming causing said recovery;

a fourth conduit for delivering the contaminated cleaning medium from said vacuuming means to said second compartment;

a fifth conduit for delivering the contaminated cleaning medium from said second compartment to said third transfer pump means, a sixth conduit for delivering said contaminated cleaning medium from said transfer pump means to said first filtering means, said transfer pump means causing said delivering to said first filtering means;

a seventh conduit for delivering said contaminated cleaning medium from said first filtering means to said second filtering means, said transfer pump means causing said delivering to said first filtering means; and an eighth conduit for delivering said decontaminated cleaning solution from said second filter means to said first compartment for reuse, said transfer pump means causing said delivering to said first compartment.

8. The apparatus of claim 7, further comprising:

a first plugging means connected to a first end of the pipeline, comprising a first orifice so that said first conduit may be placed into said first orifice for cleaning the pipeline, and a second orifice wherein said second conduit is attached to said second orifice so that contaminated solution may be recovered from the pipeline; and a second plugging means connected to a second end of the pipeline, wherein said second plugging means contains an opening for venting the pipeline to further prevent said contaminated cleaning solution from leaking and spilling from the pipeline.

9. The apparatus of claim 8, wherein said first plugging means is a first coupler and said second plugging means is a second coupler.

10. The apparatus of claim 8, wherein said second plugging means further comprises an overflow means for aiding in recovery of overflowing liquids from the pipeline, wherein said overflow means is connected to said opening of said second plugging means.

11. The apparatus of claim 10, wherein said means for aiding in recovery of overflowing liquids comprises a male quick connect device and a female quick connect hose, wherein said male device is mounted to said opening of said second plugging means and said female hose is connected to said male device.

12. The apparatus of claim 7, further comprising a storing means for storing and retracting said first conduit and a retracting means for pulling a pig through the pipeline for further removal of contaminants.

13. The apparatus of claim 12, wherein said storing means is a is a hydraulic reel and said retracting means is a winch, wherein said winch further comprises a winch cable.

14. The apparatus of claim 12, further comprising a means for independently controlling said pumping means, said vacuuming means, said transfer pump means, said storing means and said retracting means.

15. The apparatus of claim 14, wherein said means for controlling is an operator control panel.

16. The apparatus of claim 7, further comprising a spray nozzle for discharging said cleaning medium into the pipeline, wherein said spray nozzle is connected to said first conduit.

17. The apparatus of claim 16, wherein said spray nozzle is a radial vortex nozzle.

18. The apparatus of claim 1 wherein the pipeline is a gas transmission pipeline and the contaminants removed therefrom include PCBs.

19. The apparatus of claim 18, wherein said removal of PCBs results in an amount of PCBs less than ten (10) micrograms per 100 square centimeters throughout the gas transmission pipeline.

* * * * *